US006474322B1

(12) United States Patent
Ubukata et al.

(10) Patent No.: US 6,474,322 B1
(45) Date of Patent: Nov. 5, 2002

(54) IGNITION DEVICE FOR INTERNAL COMBUSTION ENGINE

(75) Inventors: Kiyomi Ubukata, Tokyo (JP); Hiroyuki Tanaka, Hitachinaka (JP); Eiichiro Kondo, Hitachinaka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/571,982

(22) Filed: May 16, 2000

(30) Foreign Application Priority Data

Jun. 22, 1999 (JP) ..... 11-175035
Jul. 6, 1999 (JP) ..... 11-191202

(51) Int. Cl.[7] ..... F02P 3/02; H01F 27/26

(52) U.S. Cl. ..... 123/634; 336/83; 336/211; 336/213

(58) Field of Search ..... 123/634; 336/83, 336/211, 213

(56) References Cited

U.S. PATENT DOCUMENTS 3,680,017 A * 7/1972 Shiari et al. ..... 336/213
5,632,259 A * 5/1997 Konda et al. ..... 123/634

FOREIGN PATENT DOCUMENTS

GB 2 105 522 A * 3/1983 ..... 335/297
JP A- 09-167709 * 6/1997
JP 9-167711 A * 6/1997 ..... H01F/30/00

* cited by examiner

*Primary Examiner*—Andrew M. Dolinar
(74) *Attorney, Agent, or Firm*—Crowell & Moring LLP

(57) ABSTRACT

The invention provides an ignition device of a cylindrical shape for an internal combustion engine, in which device it is possible to improves a productivity of a side core and a center core and to improve the efficiency of converting a magnetic flux together with the decreasing of the number of the steps of assembling process. The ignition device comprises a primary coil, a secondary coil, a center core, a side core, all of which are located concentrically in this order from the inside thereof, and a silicon steel strip having a thickness not more than 0.2 mm is used an a material of the side core so that a spirally wound, cylindrical shape is provided. Further, a thin film amorphous silicon steel strip having a flux density B8≧1.4T at a direct current magnetizing force of 800 A/m or a crystallized silicon steel strip having a thickness not more than 0.23 mm and having the same magnetic characteristics as above is used as a material of the center core, and the shape of the center core is formed in a spiral shape. Thus, it becomes possible to improve the productivity and to achieve the increase of flux density. Further, since it is possible to reduce the number of the parts in the side core, it is possible to reduce the number of the steps of an assembling process.

5 Claims, 6 Drawing Sheets

IGNITION DEVICE FOR INTERNAL COMBUSTION ENGINE

BACKGROUND OF THE INVENTION

The present invention relates to an ignition device for an internal combustion engine, and particularly to a cylindrical ignition device which is received within a plug hole.

In a cylindrical ignition device which is received within a plug hole, it is necessary to provide a center core shape which effectively converts magnetic flux. Further, since a magnetic path is formed by both of a center core and a side core, it is necessary to make the side core have a cylindrical shape.

In accordance with a conventional method, as shown in JP-A-09-167709, a structure is made such that the side core is formed to have a circular pipe shape by using a silicon steel strip having a thickness of 0.2 to 0.7 mm and one slit is formed therein (which shape is, hereinafter, referred to as "a C-type shape").

In the conventional shape of the center core, as shown in JP-A-09-167709, the center core is manufactured by laminating a plural pieces of silicon steel strip.

In the prior art mentioned above, when manufacturing the shape of the center core, it is necessary to perform laminating the silicon steel strips and fastening them. Further, there is such a case as an efficiency of converting the magnetic flux is reduced due to employing a fastening means such as caulking or the like.

Further, in the prior art mentioned above, two to four pieces of side cores are required, whereby the number of the parts is increased and the number of the steps of an assembling process is increased. Further, the efficiency of converting the magnetic flux is reduced in dependence on the width of a C-type slit.

SUMMARY OF THE INVENTION

An object of the present invention is to obtain an ignition device which can improve productivity for producing the ignition device while improving an efficiency of converting a magnetic flux by modifying a material and a structure of a center core.

Another object of the present invention is to obtain an ignition device which can reduce the number of parts and the number of the steps of the assembling process thereof while improving an efficiency of converting a magnetic flux by modifying a material and the structure of a side core and by modifying the shape of a case.

In order to achieve the objects mentioned above, in accordance with the present invention, there is provided an ignition device for an internal combustion engine in which there is used, as a material of a center core, a thin film amorphous silicon steel strip of not more than 0.1 mm in thickness or a crystallized silicon steel strip of not more than 0.23 mm in thickness, each of which amorphous and crystallized silicon steel strips has a flux density $B8 \geqq 1.4T$ at a direct current magnetizing force of 800 A/m when measured in accordance with the direct current magnetizing characteristic test prescribed in JIS C2550, Paragraph 7.2, and regarding the center core the shape thereof is formed to have a spirally wound, cylindrical shape. Accordingly, in the invention the space factor thereof is improved and the efficiency of converting a magnetic flux is improved. Further, the productivity of the ignition device can be improved by employing the spiral structure.

Further, in order to achieve the objects mentioned above, in the invention, there is provided an ignition device for an internal combustion engine in which a silicon steel strip having a thickness not more than 0.2 mm is used to reduce eddy current loss for a material of the side core and in which the shape thereof is formed to have a spirally wound, cylindrical shape. Thus, the space factor thereof is improved and the efficiency of converting a magnetic flux is improved. Further, a productivity can be improved by employing the spirally wound, cylindrical structure and the number of the steps of an assembling process can be reduced by making the parts formed in one unit.

DESCRIPTION OF THE PREFERRED EMBODIMENT

Figure 1:
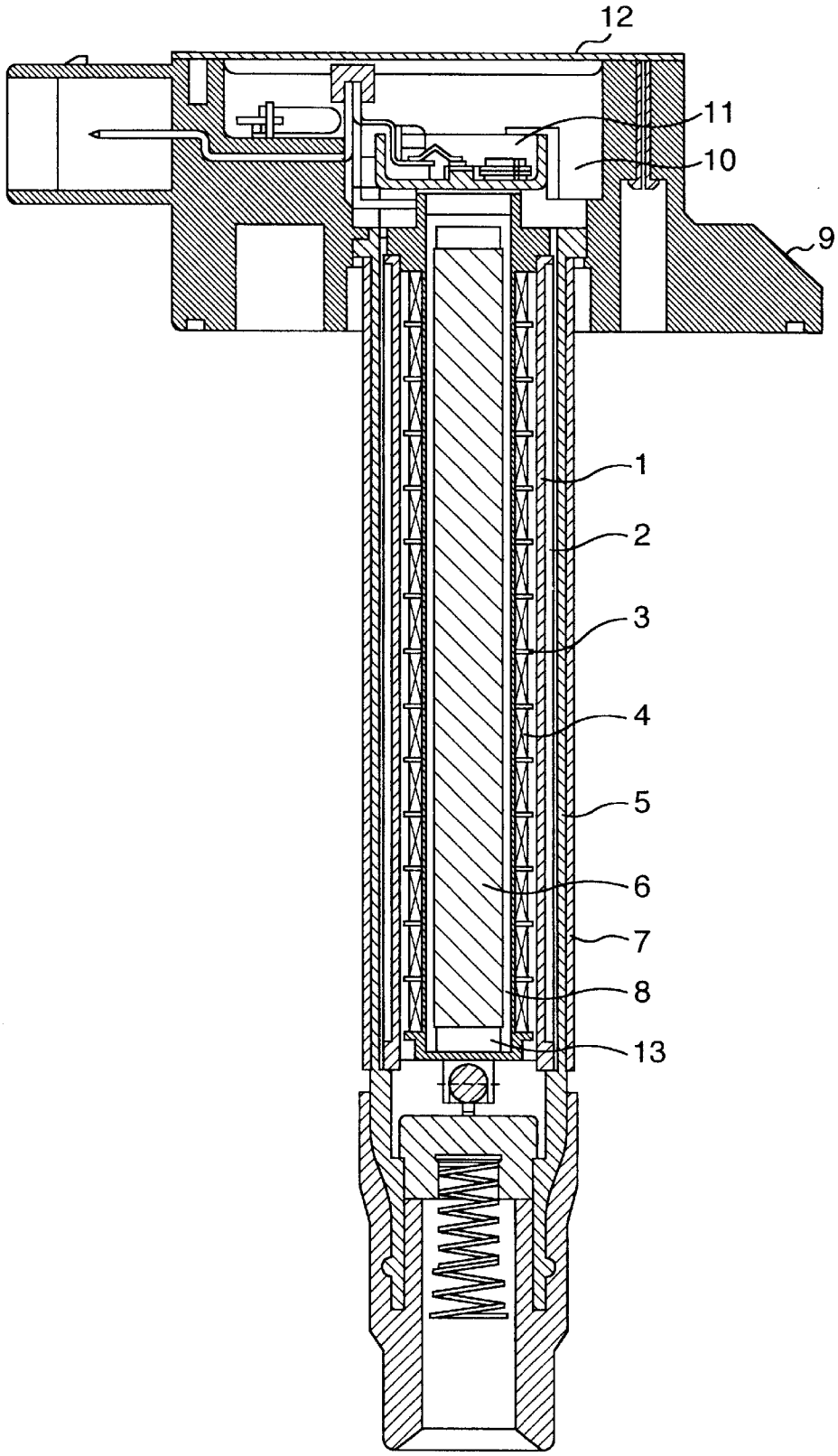
FIG. 1 is a cross sectional view which shows a structure of an ignition device embodying the invention.

A description will be given below of an embodiment in accordance with the invention with reference to the accompanying drawings. FIG. 1 is a cross sectional view which shows a structure of an ignition device provided in accordance with an embodiment of the present invention.

A primary bobbin 1 is formed with a thermoplastic synthetic resin and a primary coil 2 is wound around the primary bobbin (1). Further, a secondary coil 4 is wound around a secondary bobbin 3 formed with a thermoplastic synthetic resin. A coil portion case 5 is formed with the same thermoplastic synthetic resin as that of the primary bobbin 1, and is arranged around an outer side of the primary coil 2. A center core 6 is arranged in an inner side of the secondary bobbin 3. A side core 7 opposed to the center core is arranged in an outer side of the primary coil 2 and in an outer side of the coil portion case 5. Further, a magnet which generates a magnetic flux in a direction opposite to a direction of a magnetic flux generated in the primary coil 2 is provided at one end or both ends of the center core 6. A flexible epoxy resin 8 for reducing a stress is made to fill between the center core 6 and the secondary bobbin 3. These constituting elements are concentrically arranged from the inner side toward the outer side thereof in the order of the center core 6, the secondary coil 4, the primary coil 2, the case 5 and the side core 7. Then, the coil portion-constituting elements are forced into the case 5, and an insulating filler such as an insulating epoxy resin 10 for insulating a high voltage is made to fill therein. At an upper portion of the coil, an igniter unit 11 which includes a drive circuit is arranged within a circuit case 9 having a connector. A cover is mounted on an upper portion of the circuit case 9 with the connector so as to protect an epoxy resin surface and improve an outer appearance.

Figure 2:
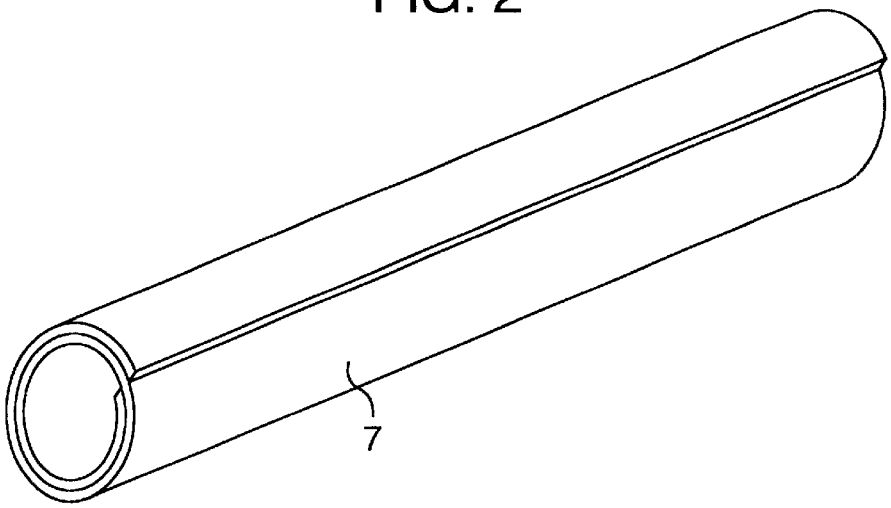
FIG. 2 is a perspective view which shows a side core in an embodiment of the invention.

FIG. 2 shows an embodiment of a side core formed in accordance with the invention.

The side core 7 is formed by using a silicon steel strip having a thickness not more than 0.2 mm, and by winding 10 times the silicon steel strip therearound while using a jig or the like, thereafter the jig, being pulled out to provide a hollow portion having a diameter of 18 to 26 mm in a center portion of the side core to thereby finally form a cylindrical shape having an outer diameter of about 20 to 28 mm, the specific value of which outer diameter depends on a plug hole inner diameter (of 20 to 28 mm) for an ignition device.

Next, a description will be given of an embodiment of a cross section of a material which is used to form the side core with reference to FIGS. 3A and 3B.

Figure 3A:
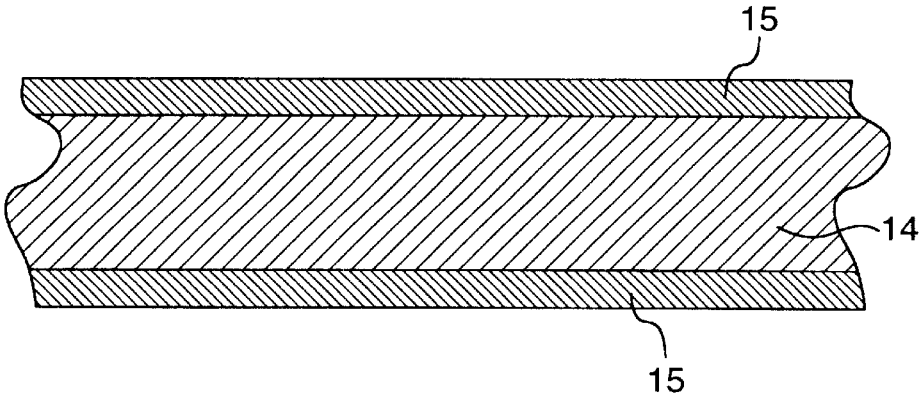
FIGS. 3A and 3B are cross sectional views each showing a material used for a side core in an embodiment of the invention.

In FIG. 3A, a flat rolled magnetic steel sheet of a sandwiched structure is used which was produced by Nippon Kokan Company Ltd. under the names of 20HF, 10HF and 05HF, in which sandwiched structure a 3% silicon portion 14 is located in the center portion thereof and a 6.5% silicon portion 15 is located in each of the surface portions so as to obtain the sandwich structure, thereby improving a workability and enabling to work it into the cylindrical shape.

Figure 3B:
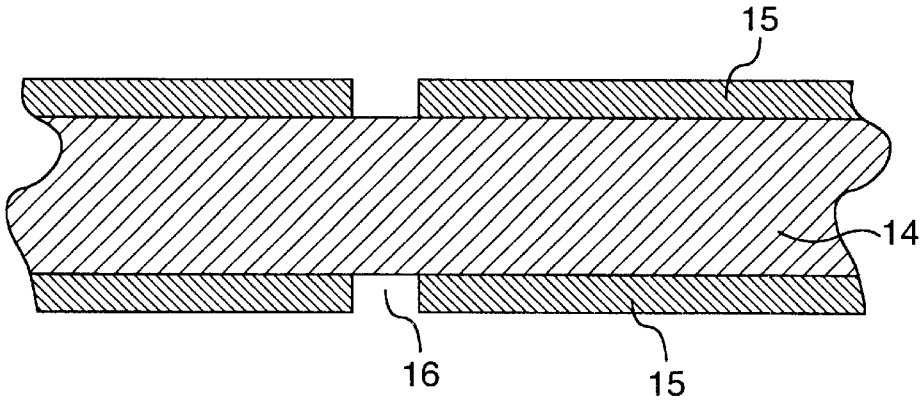

In FIG. 3B, another flat rolled magnetic steel sheet of another sandwiched structure is used which was also produced by Nippon Kokan Company Ltd., in which sandwiched structure the 3% silicon portion 14 is located in the center portion and the 6.5% silicon portion 15 is located in each of the surface portions so as to obtain the sandwich structure and at least one groove 16 is formed on each of the surface portions so that a characteristic is prevented from being deteriorated due to an eddy current loss at a time of generating a magnetic field. As regards the-working to form the groove 16, there may be used any method selected from the group of a method of forming the groove at the same time of forming the side core by using a roll jig having a projection, another method of using a laser process at a time of rolling a material and a still another method of mechanical working.

Further, the characteristic deterioration due to the eddy current loss is prevented by making the thickness of the insulating coated layer (which is currently between 0.8 and 1 $\mu$m) thicker to 2 to 5 $\mu$m.

Next, a description will be given of a shape of the case and steps of assembling the side core and the case with reference to FIGS. 4A to 4D.

Figure 4A:
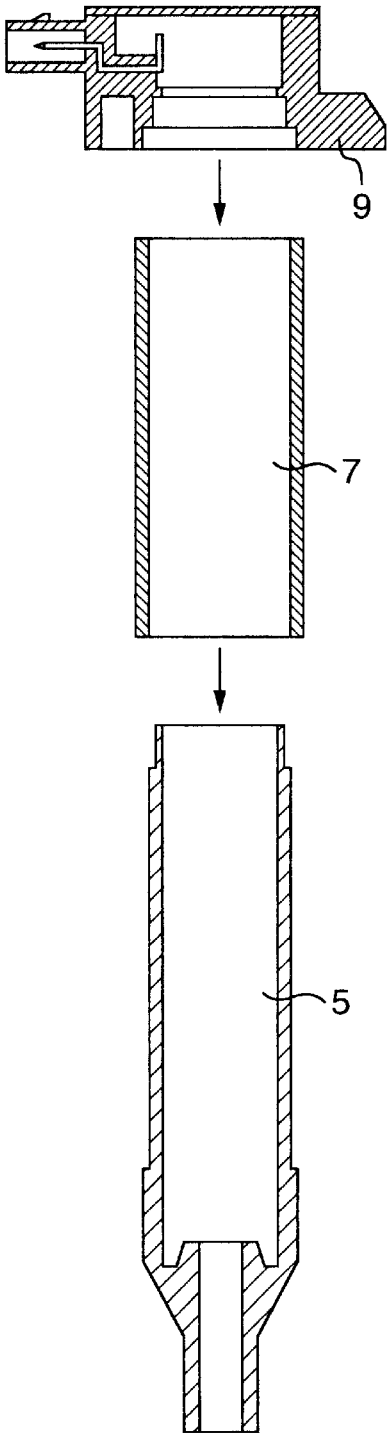
FIGS. 4A and 4B are drawings showing assembling methods of an ignition device embodying the invention.

In FIG. 4A, the case is separated into the circuit case 9 with the connector and the coil portion case 5. In the coil portion case 5, a portion which is to be forced into the side core 7 is made to have a diameter smaller than the inner diameter of the side core 7, whereby it becomes possible to assemble the coil portion case 5, the side core 7 and the circuit case 9 in this order.

Figure 4B:
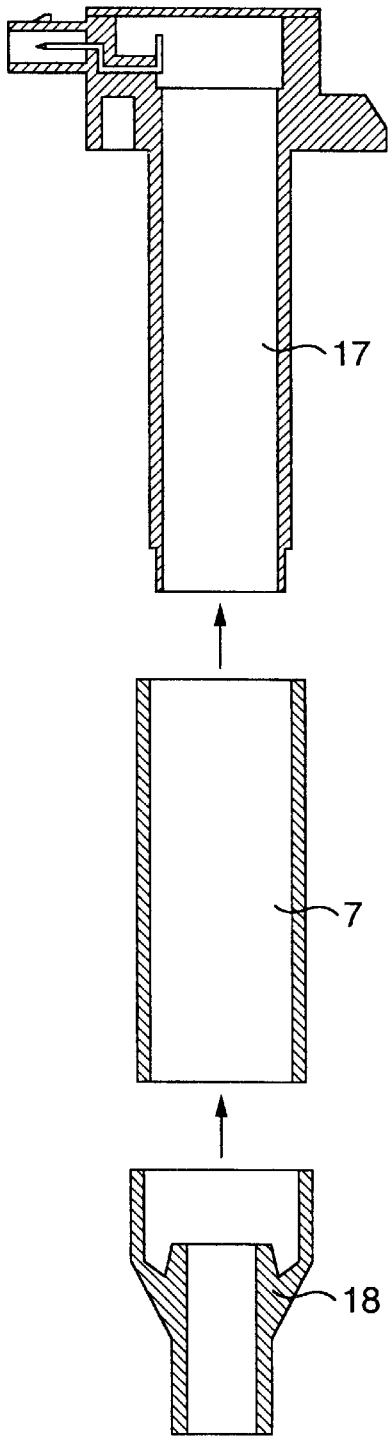

In FIG. 4B, the case is separated into a case 17 obtained by integrally forming both of the circuit with the connector and the coil portion and a case 18 only for a side of a high voltage portion. In the circuit-and-coil integrating case 17, a portion which is to be forced into the side core 7 is made to have a diameter smaller than the inner diameter of the side core 7, whereby it becomes possible to assemble the circuit-and-coil integrating case 17, the side core 7 and the high voltage case 18 in this order.

Figure 4C:
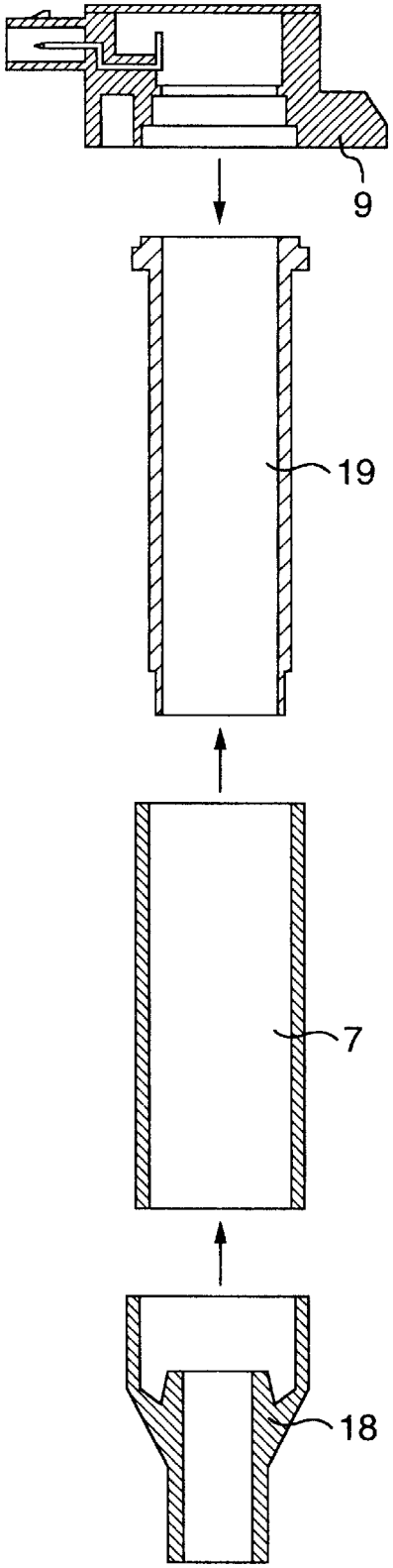
FIGS. 4C and 4D are drawings showing other assembling methods of the ignition device embodying the invention.

In FIG. 4C, the case is separated into the circuit case 9 with the connector, an intermediate portion case 19 in which the coil is inserted, and a case 18 only for the side of the high voltage portion. In the intermediate portion 19, a part which is to be forced into the high pressure case 18 is made to have a diameter smaller than the inner diameter of the side core 7, and another part thereof which is to be forced into the circuit case 9 is made to have a diameter larger than the outer diameter of the side core, whereby it becomes possible to assemble the intermediate portion case 19, the side core 7, the high pressure case 18 and the circuit case 9 in this order.

Figure 4D:
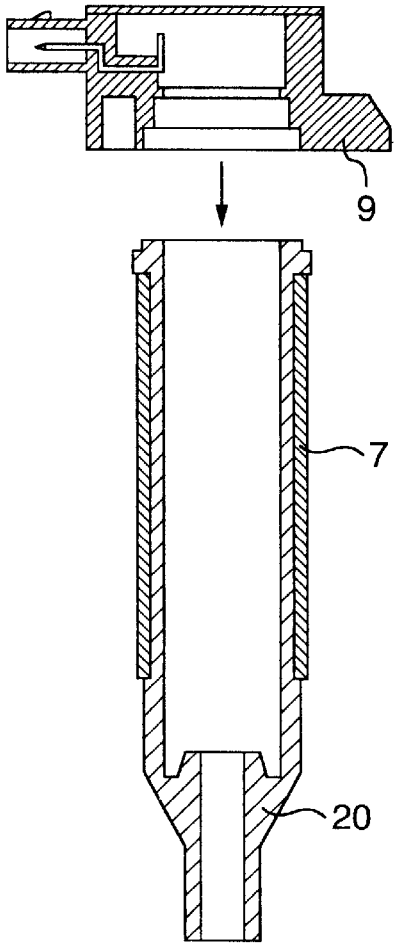

In FIG. 4D, the case is separated into the circuit case 9 with the connector and the coil portion case, and the coil portion case is molded by an injection molding or the like while inserting the side core 7, whereby it is possible to assemble a case 20 with the side core 7 and the circuit case 9 in this order.

As mentioned above, by using the silicon steel strip having a thickness not more than 0.2 mm, the forming process can be performed by winding the silicon steel strip around the jig, so that the productivity can be improved. Further, since the spirally wound cylindrical shape is adopted and since the space factor can be increased, it is possible to improve the flux density. In this case, when the same flux density is needed, the structure can be made further compact. Further, since it is possible to reduce the number of the parts in the side core, the number of the steps of the assembling process can be reduced.

Figure 5:
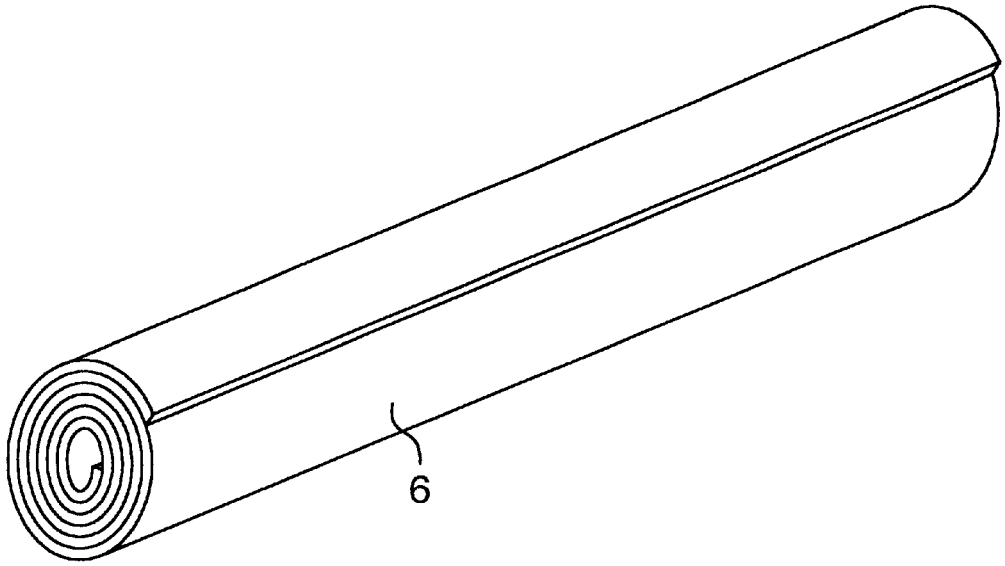
FIG. 5 is a perspective view which shows a shape of a whole of a center core formed in accordance with an embodiment of the invention.

FIG. 5 shows an embodiment of a center core formed in accordance with the invention.

The center core 6 is formed to have a spirally wound, cylindrical shape by steps of preparing a thin film amorphous silicon steel strip of not more than 0.1 mm in thickness (which was produced by Nippon Hishohshitu Company, Ltd. under the name of Amorphous 2605 TCA) or a crystallized silicon steel strip of not more than 0.23 mm in thickness, each of which amorphous and crystallized strips has a flux density 1.4T or more at a direct current magnetizing force of 800 A/m when measured in compliance with the direct current magnetizing characteristic test prescribed in JIS C2250, Paragraph 7.2, and winding the material around a jig or the like.

Next, the embodiments of a cross sectional shape of the center core are explained below with reference to FIGS. 6A and 6B.

Figure 6A:
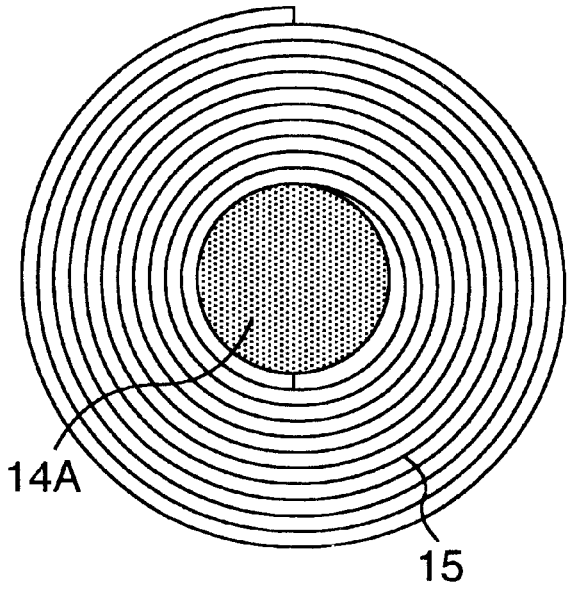
FIGS. 6A and 6B are cross sectional views each of which shows a center core formed in accordance with an embodiment of the invention.

In FIG. 6A, a round bar iron core 14A of 4 to 8 mm in diameter made of a pure iron or a magnetic mild steel bar or the like is provided at a center portion of the center core, and the above-described amorphous silicon steel strip or the crystallized silicon steel strip described above is wound therearound, whereby a composite bar-like core 15 finally having an outer diameter between about 6 and about 10 mm is obtained which has a spirally wound portion around a solid portion.

Figure 6B:
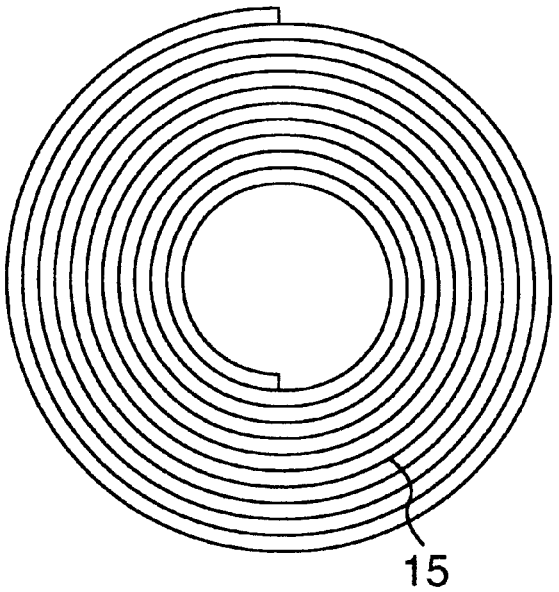

In FIG. 6B, a jig having a size between about 1 and 8 mm is used, the amorphous or crystallized silicon steel strip described above being wound therearound, thereafter the jig is pulled out to thereby form a spirally wound, cylindrical core 15A having an outer diameter of about 6 to 10 mm, which core 15A has a hollow portion of 4 to 8 mm in diameter in the center portion of the center core.

Figure 7:
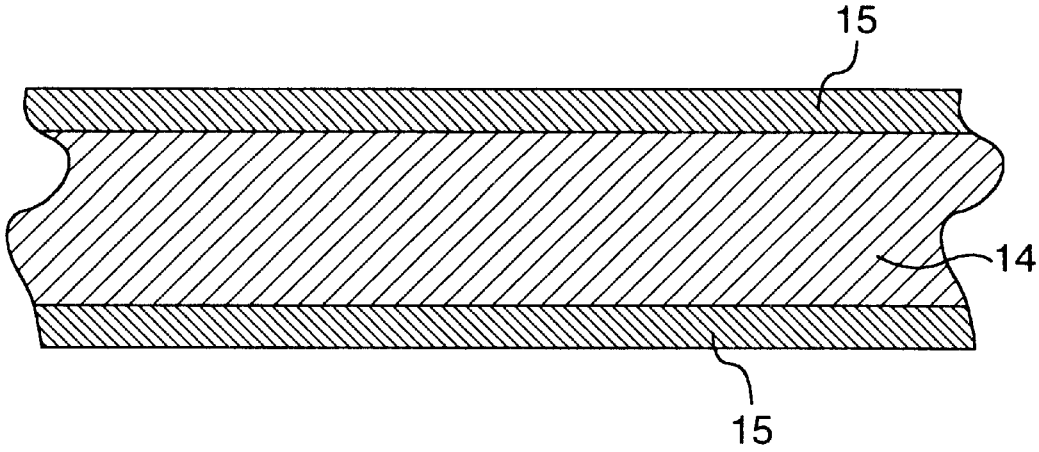
FIG. 7 is a cross sectional view which shows an embodiment of a material used for the center core formed in accordance with the invention.

Next, a description will be given of an embodiment of a cross section of the silicon steel strip used as one of the materials for the center core with reference to FIG. 7.

A flat rolled magnetic steel strip of the sandwiched structure described above which was produced by Nippon Kokan Company Ltd. is used, in which strip a 3% silicon portion 14 is located in the center portion thereof and 6.5% silicon portions 15 are located at the surface portions thereof so as to obtain the sandwich structure, thereby improving a workability and enabling to work the strip into the spiral shape.

As mentioned above, by employing the thin film amorphous silicon steel strip having the thickness not more than 0.1 mm or the crystallized silicon steel strip having the thickness not more than 0.23 mm, the product can be formed by winding it around the jig or the like, thereby improving the productivity. At the same time, because of the increasing of the space factor thereof, it is possible to improve an efficiency of converting a magnetic flux.

According to the invention, it is possible to improve the productivity by the core of the spirally wound, cylindrical shape. Further, according to the invention, it is possible to raise the space factor of the center and side cores formed for a stick-shaped ignition coil to be fitted in an ignition plug-mounting hole, whereby it is possible to improve the flux density. On the other hand, in the case of the same flux density, it is possible to obtain a further compact structure. Further, since it is possible to reduce the number of the parts in the center core and the side core, it is possible to reduce the number of the steps of assembling process.

What is claimed is:

1. An ignition device of a cylindrical shape for an internal combustion engine comprising:

a center core, a secondary coil wound around a secondary bobbin and a primary coil wound around a primary bobbin, all of which are concentrically located in this order from the inside thereof within a coil portion case previously made of a thermoplastic synthetic resin;

a flexible epoxy resin made to fill between said center core and the secondary bobbin;

a thermosetting synthetic resin made to fill in a periphery of each of said constituting elements located within the case;

a side core located at an outer side of the coil portion case;

a circuit case with a connector for receiving a drive circuit which circuit case is provided at a head portion of said coil portion case;

said cylindrical ignition device being adapted to be directly connected to an ignition plug and to be received within a plug hole, wherein said side core has a spirally wound, cylindrical shape and is made of a silicon steel strip having a thickness not more than 0.2 mm.

2. An ignition device as claimed in claim 1, wherein each of the circuit case and the coil portion case has such a shape as to be capable of being assembled in the side core.

3. An ignition device of a cylindrical shape for an internal combustion engine comprising:

a center core, a secondary coil wound around a secondary bobbin and a primary coil wound around a primary bobbin, all of which are concentrically located in this order from the inside thereof within a coil portion case previously made of a thermoplastic synthetic resin;

a flexible epoxy resin made to fill between said center core and the secondary bobbin;

a thermosetting synthetic resin made to fill between said center core and the secondary bobbin;

a thermosetting synthetic resin made to fill in a periphery of each of said constituting elements located within the case;

a side core located at an outer side of the coil portion case;

a circuit case with a connector for receiving a drive circuit which circuit case is provided at a head portion of said coil portion case;

said cylindrical ignition device being adapted to be directly connected to an ignition plug and to be received within a plug hole, wherein the center core has a spirally wound, cylindrical shape; and wherein said side core has a spirally wound, cylindrical shape and is made of a silicon steel strip having a thickness not more than 0.2 mm.

4. An ignition device as claimed in claim 3, wherein a material of the center core is a thin film amorphous silicon steel strip having a flux density $B8 \geqq 1.4T$ at a direct current magnetizing force of 800A/m when measured in compliance with direct current magnetizing characteristic test prescribed in JIS C2250, Paragraph 7.2 and a thickness not more than 0.1 mm.

5. An ignition device as claimed in claim 3, wherein the material of the center core is a crystallized silicon steel strip having a thickness not more than 0.23 mm.

* * * * *